United States Patent [19]

Ernst

[11] Patent Number: 4,738,043

[45] Date of Patent: Apr. 19, 1988

[54] MESSAGE BOARD

[76] Inventor: Paul F. Ernst, 2436 Dorian Dr., Cincinnati, Ohio 45215

[21] Appl. No.: 908,694

[22] Filed: Sep. 18, 1986

[51] Int. Cl.[4] ..... G09F 7/02

[52] U.S. Cl. ..... 40/618; 40/10 R; 40/622

[58] Field of Search ..... 40/618, 154, 620, 622, 40/10 R, 2 R, 617

[56] References Cited

U.S. PATENT DOCUMENTS

| | | | |
|---|---|---|---|
| 351,862 | 11/1886 | Grosjean | 40/618 |
| 625,681 | 5/1899 | Johnson et al. | 40/618 |
| 705,275 | 7/1902 | Mosher et al. | 40/618 |
| 2,039,248 | 4/1936 | Huppert | 40/618 |
| 2,540,718 | 2/1951 | Duskin | 40/10 R |
| 3,296,724 | 1/1967 | Deuchar | 40/618 |
| 3,371,439 | 3/1968 | Smith et al. | 40/154 |
| 3,590,507 | 7/1971 | Wren | 40/618 |
| 3,782,015 | 1/1974 | Esry | 40/154 |
| 4,531,320 | 7/1985 | James | 40/621 |

*Primary Examiner*—Gene Mancene
*Assistant Examiner*—J. Hakomaki
*Attorney, Agent, or Firm*—Wood, Herron & Evans

[57] ABSTRACT

A message board has a back plate, strips bearing alphanumeric characters and being secured to the forward surface of the back plate, and a see-through face plate attachable to the back plate and communicating with character strips in such a manner as to prevent displacement. The back plate is preferably provided with locating pins projecting from a forward surface thereof to receive the character being strips thereon prior to attachment of the face plate. The strips have apertures for receiving the pins therein. Alternatively, magnetic strips and ferrous elements are used for magnetically securing the strips to the back plate.

7 Claims, 1 Drawing Sheet

FIG. 1
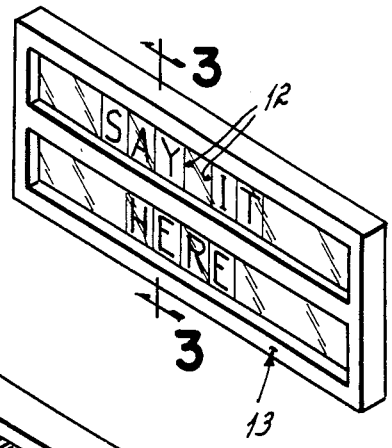
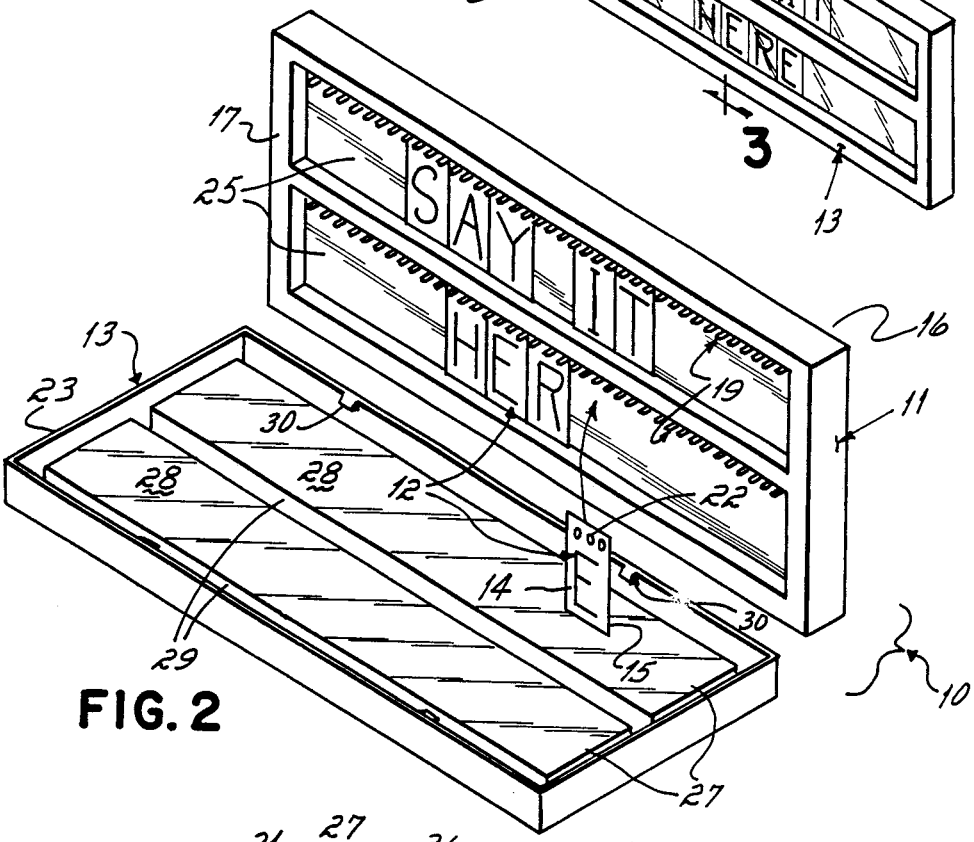
FIG. 2
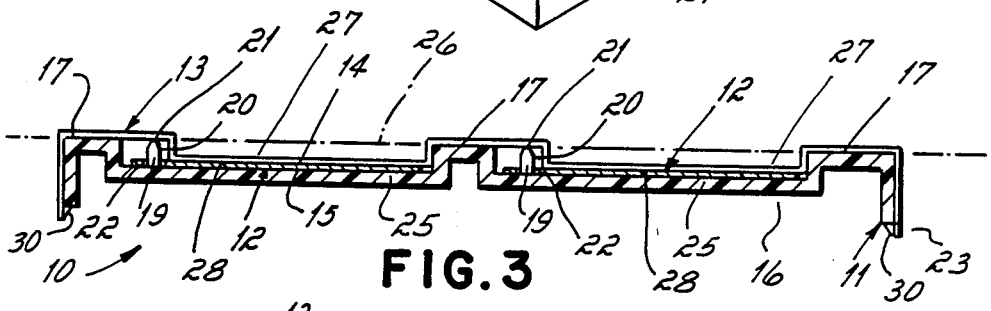
FIG. 3
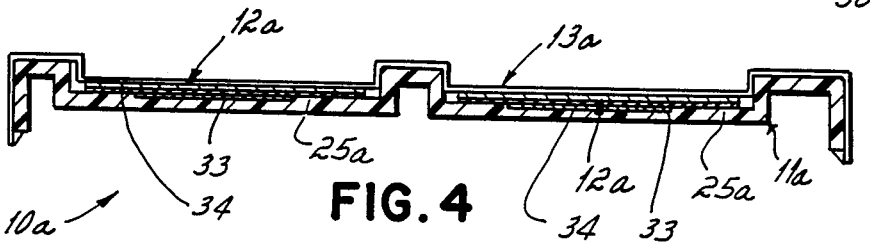
FIG. 4

MESSAGE BOARD

BACKGROUND OF THE INVENTION

This invention relates to message boards and more particularly to message boards for displaying interchangeable messages made up of alphanumeric character bearing strips.

Prior art message boards hve included device for mounting changeable, alphanumeric character bearing elements. A cover plate has been attached to such devices in engagement with the front surface of the character bearing element to prevent their displacement. Frictional force to hold the characters in position was provided by mounting the cover upon the device with fastening screws, for example.

One disadvantage in message boards of this type has been that the device was required to be removed from any support and laid flat, parallel with the ground, when a message was set up or changed. Otherwise, without the support of the cover, which was removed, the alphanumeric character bearing elements would fall to the ground. No frictional holding forces were applied until the cover was secured to the device. Therefore, every change of the message necessitated a dismounting of the back plate and a disassembly of the cover.

Other prior displays alleviated the inconvenience of dismounting the back plate each time that the message was changed by adding a trough recessed within the back plate. This trough provided a ledge or opening for mounting elements thereon.

The use of troughs, however, was insufficient to prevent character element displacement when these message display devices were attached to moving or vibrating surfaces, such as to vehicles. Falling and sliding of character elements out of place continued to occur with any message device not used in a stationary application.

Another solution to the problem of displaced character elements was to provide key holes in the back plate and characters with pegs projecting rearwardly for insertion into these key holes. The snug fit of the alphanumeric characters into these key holes prevented displacement of the characters.

Nevertheless, a disadvantage in message boards of this type was the space required for storing these alphanumeric characters. Character elements having rearwardly projecting pegs were bulky and not easily stored. Since the variety of messages which may be displayed is directly proportional to the available supply of a number of alphanumeric character elements, more convenient storage of character elements has been desirable to provide a greater number of easily stored elements to allow greater message variety.

Another type of prior message device included a cover plate hinged to the device at an edge thereof. Such devices were popular for use in trinkets or key chains and the like. Grooves were placed in the trough to slidably receive character elements. This required an entire character element line to be slidably mounted within the message board in the correct sequence. The hinged cover also required additional attachments or snaps to secure the cover onto the device.

Message boards of these types, when used outdoors, are subject to leakage, weather intrusion and difficulties in message adjustment or changes. Gaps necessary to provide a minimum clearance distance to allow free hinging of the cover allow seepages of moisture between the face plate and the back plate. This moisture obscures messages and subjects the character strips to additional wear and tear. Moreover, such devices are typically mounted for stationary use and does not provide for suitable character element security against displacement when subjected to vibrations or movement such as generated by a vehicle.

It is therefore an object of this invention to provide a message board in which alphanumeric character strips are securely disposed against movement due to vibration of the board.

It is another object of this invention to provide a message board which does not require dismounting of the board from a support in order to change the alphanumeric characters, but wherein the message can be changed with the board in vertical disposition.

It is yet another object of this invention to provide a message board together with securably mountable, readily storable, flat character bearing elements.

BRIEF SUMMARY OF THE INVENTION

To these ends a message board according to a preferred embodiment of the invention comprises a back plate, a selectively releasable, see-through face plate and alphanumeric character bearing strips hung on pins extending forwardly from the back plate and held thereon by the cooperating face plate. The back plate has a forward face, a rearward face and at least one row of locating pins projecting from the forward face for receipt of apertures in the alphanumeric character strips. Upon attachment to the back plate, the rear surface of the see-through face plate is operably disposed with respect to the locating pins to prevent displacement of the character bearing strips from the locating pins to maintain a message.

In an embodiment of this invention, locating pins project from the bottom of a trough which is recessed in the back plate. The face plate has a trough which is receivable within the back plate trough. The face plate trough has a rear bottom surface and two rear side surfaces with one of these rear side surfaces being disposed proximate the side surfaces of the locating pins to prevent displacement of the character bearing strips. When the face plate is in position, the pins extend between the side of the back plate through and a rear side surface of the face plate trough to capture the character bearing strips on the pins.

In another embodiment of invention, a magnetic strip is disposed along the forward surface of the back plate. Alphanumeric character bearing strips have a ferrous element on the rearward surface to allow magnetic securing of the strip to the back plate. Upon attachment of the see-through face plate, the rearward surface of the face plate engages the character strips to prevent their displacement.

Other and further important objects and advantages of this invention will become apparent from the following written description of a preferred embodiment of the invention and from the accompanying drawings in which:

BRIEF DESCRIPTION OF THE DRAWINGS

FIG. 1 is a perspective view of an assembled message board embodying the principles of this invention;

FIG. 2 is a perspective view of a message board of FIG. 1, but showing the components thereof in disassembled form;

FIG. 3 is a cross section taken along line 3—3 of FIG. 1; and

FIG. 4 is a cross section similar to FIG. 3, showing an alternate embodiment of the invention.

DETAILED DESCRIPTION OF THE DRAWINGS

As shown in the drawings, a message board 10 according to a preferred embodiment of the invention comprises a back plate 11, alphanumeric character bearing strips 12 and a see-through face plate 13 which is selectively attachable to the back plate 11 over the character bearing strips 12 to prevent displacement thereof. Each of the character bearing strips 12 has a forward surface 14 and a rearward surface 15.

The back plate 11 is preferably molded to a shape which is most clearly shown in FIGS. 2 and 3. The rearward face 16 of the back plate 11 may be used to mount the message board to a surface for support. For example, screws, straps, clamps, hook and loop type fasteners or other suitable devices can be used to mount the board 10 to any suitable surface such as a wall, or on a vehicle bumper.

The forward face 17 of board 10 provides for the secured placement of alphanumeric character bearing strips 12 thereon. Locating pins 19 having side surfaces 20 terminating in a free end 21 project forwardly from the forward face 17 of the back plate 11. These locating pins 19 are disposed in a row along the face 17 of back plate 11 for receipt in apertures 22 provided in the alphanumeric character bearing strips 12. In this regard, the pins are disposed in a row with predetermined spacing and apertures (preferably two or more) and the strips are placed over the pins.

Thus, in one embodiment of this invention, the locating pins 19 are spaced equidistantly from each other as are the apertures 22 in the alphanumeric character strips 12. This enables secured mounting of any variety of character strips 12 onto the back plate 11 before the face plate 13 is attached as shown in FIG. 2 and regardless of the number of apertures in a particular strip.

The see-through face plate 13 provides further stability and security to the message board. The face plate 13 has a rear surface 23 which cooperates with the locating pins 19 to prevent displacement of the character strips 12.

In the preferred embodiment of this invention, the back plate 11 has at least one (two are shown) trough 25 recessed rearwardly from its forward face 17. The free ends of the locating pins 19 are contiguous with a plane 26 defined by the unrecessed forward face 17 of the back plate 11. The face plate 13 is provided with at least one trough 27 (two are shown) receivable within the back plate trough 25. The face plate trough 27 has a rear bottom surface 28 and rear side surfaces such as surface 29. When the message board is assembled, one rear side surface 29 is disposed proximate to the side surfaces 20 of locating pins 19. As shown in FIG. 3, the pin projects forwardly between the side of the trough in the back plate and the rear side of the face plate trough. This captures the character bearing strips on the pins and prevents the displacement of strips 12 when the strips 12 are secured and the face plate 13 attached to provide a message. The final assembled disposition is shown most clearly in FIG. 3.

The face plate is preferably attached with releasable tabs 30 projecting from the rear surface of the face plate 23. These tabs releasably snap onto the back plate for holding the face plate thereon.

This stable assembly of back plate 11, character bearing strips 12, and face plate 13 enables the message board to be mounted for support in an outdoor non-stationary environment without displacement of the message thereon.

As shown in the drawings, the preferred embodiment includes both a back plate and a face plate having two parallel troughs, one above the other, for providing a two-line message. Also, it will be appreciated that more than one trough can be used, and that the face plate can be provided with a similar number. Also, it should be appreciated that yet other configuations of back plate, face plate and pins can be used to secure the objects of the invention thereon, it only being necessary to provide means on the face plate for cooperating with the pins to capture the character bearing strips thereon.

FIG. 4 shows a cross section similar to FIG. 3, but of another embodiment of this invention. Alphanumeric character strips **12*a* are magnetically secured to a back plate 11*a* prior to the attachment of a see-through face plate 13. In this type of message board, instead of a row of locating pins 19, the back plate 11*a* provides a magnetic strip 33 disposed along the front face of troughs 25*a*. A ferrous element 34 is provided on the rearward surface of the character strips 12*a* to allow securing in place of a message prior to attachment on the face plate. in this embodiment, the rearward surface of the face plate 23 preferably engages the forward surfaces of each of the character strips 14 to prevent displacement of the message. It should also be appreciated that this magnetic embodiment of the invention may be varied by forming a back plate out of magnetic impregnated plastic rather than disposing a magnetic strip 33 along the front face of troughs 25*a***.

Various configurations of the back plate and face plate may be molded to form the message board of this invention. In the preferred embodiment, the back plate and the face plate have a predetermined length and the length of the back plate trough and the face plate trough are shorter than these respective predetermined lengths. To enable the rear facing convex portion of the face plate trough to be received within the forward facing concave portion of the back plate trough, the overall length of the face plate trough is slightly less than the length of the back plate trough.

The widths of the respective troughs must be such that they enable the rear portion of the face plate trough to be received within the back plate trough with one rear side surface of the face plate trough disposed proximate a side surface of the forwardly projecting locating pins.

Moreover, the length of the character bearing strips 12 is preferably approximately equal to the interior width of the trough in the back plate to maximize the height of the characters.

Also, it should be appreciated that the elements described above can be made of any suitable materials such as plastic, synthetic material, or other materials, and that the face plate and back plate are made by any suitable process such as molding.

Other modifications and embodiments will be readily apparent to those of ordinary skill in the art without departing from the scope of this invention, and applicant intends to be bound only by the claims appended hereto.

I claim:

1. A message board for displaying a plurality of separate, alphanumeric character bearing strips having mounting apertures therein, said message board comprising:

a back plate having forward and rearward faces;

a plurality of locating pins projecting from said forward face and disposed in a row, each locating pin having side surfaces and terminating in a free end for receipt within an aperture in a character bearing strip; and a see-through face plate attached to said back plate, being selectively releasable therefrom, and having a rear surface operably disposed with respect to said pins for preventing displacement of said strips from said pins when said strips are selectively placed thereon to display a message;

wherein said back plate includes a trough on said forward face, said pins extending forwardly from a forwardly facing bottom of said trough;

at least one trough in said face plate;

a rear side of said face plate trough being received within said back plate trough;

said face plate trough rear side having a rear bottom surface and two rear side surfaces;

said face plate being attached to said back plate with one rear side surface of said face plate trough disposed adjacent said side surfaces of said locating pins, thereby preventing displacement of any of said character bearing strips thereon.

2. A message board as in claim 1, including two troughs in said back plate and two cooperating troughs in said face plate, a row of pins in each trough of said back plate and rear surfaces of said face plate troughs being disposed proximate said engaging surfaces of said locating pins to prevent dislocation from said pins of strips carried thereon.

3. A message board as in claim 1, wherein said forward surface of said back plate defines a plane;

said back plate trough being recessed rearwardly from said plane;

said locating pins projecting from the forwardly facing bottom of said back plate trough to a distance wherein each of said free ends of said locating pins is contiguous with said plane.

4. A message board as in claim 3, in which said rear bottom surface of said face plate trough is disposed rearwardly of said plane when said face plate is operably attached to said back plate.

5. A message board as in claim 4, in which one rear side surface of said face plate trough is spaced away from a side of said back plate trough to accommodate said locating pins projecting therebetween.

6. A message board as in claim 1, in which the back and front face plates each have a respective predetermined length and wherein the length of said back plate trough and said front plate trough is shorter than said respective predetermined lengths.

7. A message board as in claim 1, wherein the height of each of said strips is approximately equal to the width of said trough in said back plate.

* * * * *